US008601624B2

(12) United States Patent
Lewis et al.

(10) Patent No.: US 8,601,624 B2
(45) Date of Patent: Dec. 10, 2013

(54) PRESSURE RELIEVING MATTRESS

(76) Inventors: Jan Anthony Lewis, Caerphilly (GB); Ian Robert Mahoney, Laleston Close (GB)

( * ) Notice: Subject to any disclaimer, the term of this patent is extended or adjusted under 35 U.S.C. 154(b) by 1113 days.

(21) Appl. No.: 11/919,193

(22) PCT Filed: Apr. 13, 2006

(86) PCT No.: PCT/GB2006/001353

§ 371 (c)(1),
(2), (4) Date: Jul. 18, 2008

(87) PCT Pub. No.: WO2006/114571

PCT Pub. Date: Nov. 2, 2006

(65) Prior Publication Data

US 2009/0144911 A1 Jun. 11, 2009

(30) Foreign Application Priority Data

Apr. 26, 2005 (GB) ..... 0508403.3

(51) Int. Cl.
*A47C 27/15* (2006.01)
*A47C 27/18* (2006.01)

(52) U.S. Cl.
USPC ..... 5/722; 5/691; 5/925; 5/926

(58) Field of Classification Search
USPC ..... 5/722, 691, 727, 738, 925, 926
See application file for complete search history.

(56) References Cited

U.S. PATENT DOCUMENTS

| | | | | | |
|---|---|---|---|---|---|
| 3,249,952 | A | | 5/1966 | Janapol | |
| 4,064,578 | A | * | 12/1977 | Yamada | 297/452.27 |
| 4,753,480 | A | * | 6/1988 | Morell | 297/452.27 |
| 4,803,744 | A | * | 2/1989 | Peck et al. | 5/713 |
| 4,947,500 | A | * | 8/1990 | Seiler | 5/713 |
| 5,201,780 | A | * | 4/1993 | Dinsmoor et al. | 5/679 |
| 5,860,174 | A | | 1/1999 | Failor | |
| 7,555,796 | B2 | * | 7/2009 | Lewis et al. | 5/690 |
| 2004/0003471 | A1 | | 1/2004 | Vansteenburg | |
| 2005/0172414 | A1 | * | 8/2005 | Lewis et al. | 5/722 |
| 2009/0144911 | A1 | * | 6/2009 | Lewis et al. | 5/722 |
| 2012/0284926 | A1 | * | 11/2012 | Tyree et al. | 5/691 |

FOREIGN PATENT DOCUMENTS

| | | |
|---|---|---|
| EP | 1464258 | 10/2004 |
| JP | 2001104405 | 4/2001 |

OTHER PUBLICATIONS

International Search Report for PCT/GB2006/001353.

* cited by examiner

*Primary Examiner* — Robert G Santos
(74) *Attorney, Agent, or Firm* — Stockwell & Smedley, PSC

(57) ABSTRACT

This invention relates to mattresses such as a pressure relieving mattress and in particular ones for profiling beds. The mattress comprises a base portion 11, a carriage portion 12, an upper portion 13 and an inflatable pressure relieving underlay 14 disposed between the carriage 12 and the upper portion 13. The facing surfaces 15 and 16 of the base portion 11 and the carriage portion 12, respectively, are coated with a low friction material so that the two slide easily relative to one another. This sliding movement is restricted to longitudinal relative movement by the engagement of co-operating formations 17, 18.

The combination provides particularly flexible mattress arrangement which also avoids the problem of the leg section of the mattress kicking upwardly when a profiling bed is articulated.

9 Claims, 3 Drawing Sheets

PRESSURE RELIEVING MATTRESS

This invention relates to mattresses such as a pressure relieving mattress.

As is set out in our co-pending application GB-A-2405582 there is a problem with mattresses, which arises when they are used with profiling beds, because instead of simply adopting the profile of the bed, when it is articulated, the foot end of the mattress, at least, tends to spring up putting unwanted pressure on the users heels and calves. Also shear friction occurs due to movement of the mattress relative to the patient.

The solution adopted in that earlier specification was to enable an upper, generally pressure relieving portion to slide longitudinally relative to a base portion, which engaged the bed, by providing a low friction interface.

This design has been extremely successful in respect of the type of mattress described in the earlier specification, but has proved to be not acceptable where it is desired to use either a conventional inflatable pressure relieving overlay or mattress or a combination of a foam pressure relieving insert or overlay and a pressure relieving inflatable underlay for example the type described in our co-pending PCT Patent Application No. GB2006/001220 filed which claims priority from British Patent Application 0506876.2 filed on 5 Apr. 2005, the contents of which are incorporated herein.

From one aspect the invention consists in a mattress for a profiling bed, including a base portion and an upper portion overlying the base portion and having an interface between the portions which has a coefficient friction low enough such that the portions can slide longitudinally relative to each other characterised in that the upper portion is mounted on a carriage portion and that the interface lies between the carriage portion and the base portion.

In one embodiment the mattress further includes an inflatable pressure relieving underlay between the carriage portion and the upper portion, in which case the upper portion may be a foam pressure relieving overlay or insert alternatively the upper portion may be an inflatable pressure relieving mattress or overlay. Preferably the carriage portion is made of foam which is relatively rigid.

The carriage portion may be in the form of a tray and additionally or alternatively it may have formations for cooperating with formations on the base portion to restrict the sliding movement between the carriage and the base portion to longitudinal movement.

The interface may be a sheet of suitably treated polyurethane material stuck onto one or both of the facing surfaces of the carriage or base portion or a similar material could be sprayed or otherwise deposited onto that surface. Alternatively the interface could be formed by an intermediate body such as a partially inflated air sac or sacs.

Although the invention has been defined above it is to be understood that it includes any inventive combination of the features set out above or in the following description.

The invention may be performed in various ways and specific embodiments will now be described with reference to the accompanying figures, in which.

Figure 1:
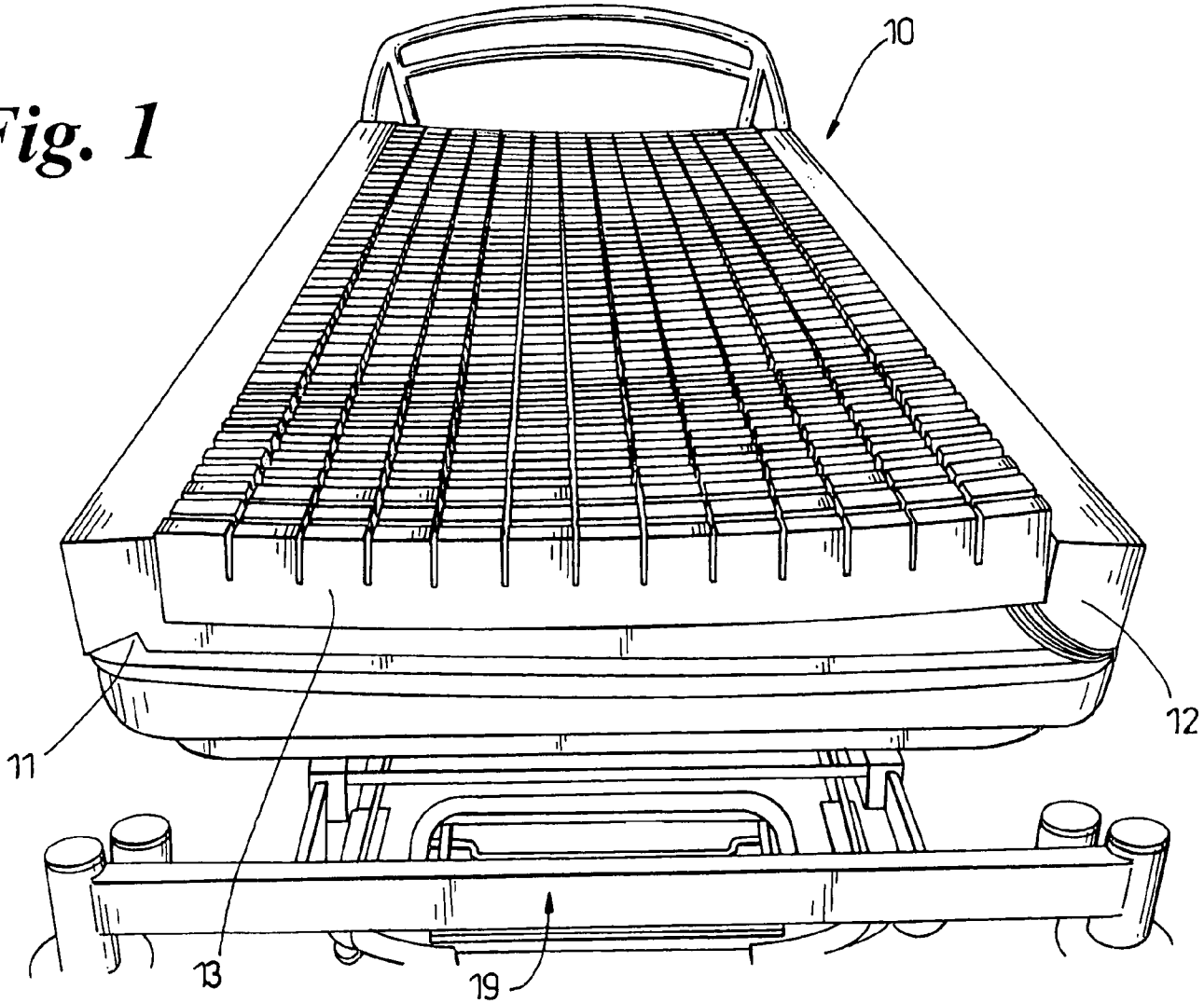
FIG. 1 is a view from one end of a mattress on a flat bed.
Figure 2:
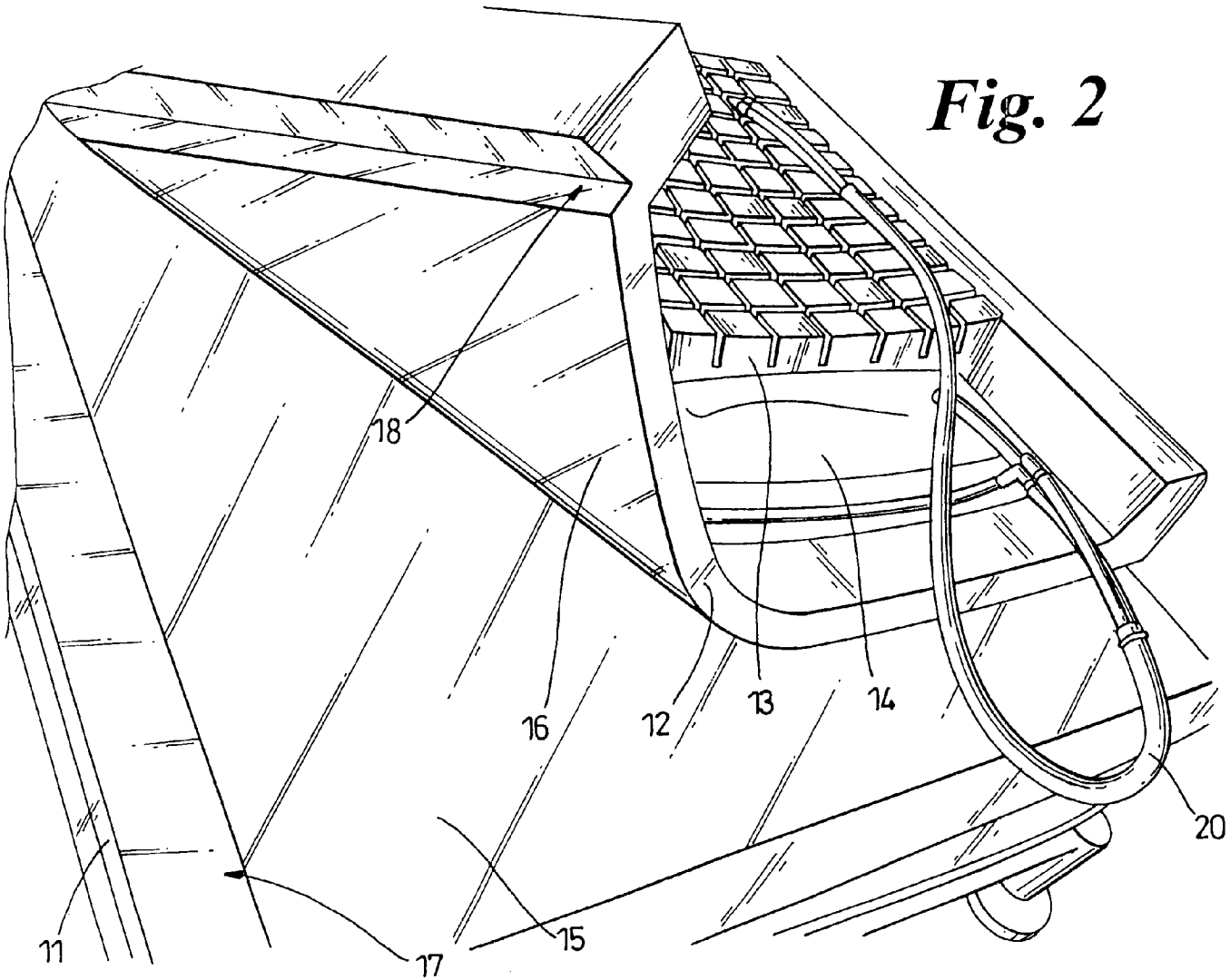
FIG. 2 is an enlarged view from above with the elements of the mattress relatively displaced for clarity of illustrations.

As can be seen in FIGS. 1 and 2 a mattress generally indicated at 10 includes a base portion 11, a carriage portion 12, an upper portion 13 and an inflatable pressure relieving underlay 14 disposed between the carriage 12 and the upper portion 13.

The base portion 11 and the carriage portion 12 are made of relatively dense foam, whereas the upper portion 13 is made of softer foam and profiled in such a way as to provide routine pressure relieving characteristics in a manner which is well known in the art. The facing surfaces 15 and 16 of the base portion 11 and the carriage portion 12, respectively, are coated with a low friction material so that the two slide easily relative to one another. This sliding movement is restricted to longitudinal relative movement by the engagement of cooperating formations 17, 18 on the base portion 11 and carriage portion 12 respectively.

The combination of the low friction surfaces 15, 16 and the cooperating formations 17, 18 mean that when the bed 19 is profiled, the carriage 12 can slide longitudinally relative to the base 11 allowing the base to follow the contours of the profiled bed 19 in a manner which is fully described in our co-pending application GB-A-2405582, which is incorporated herein by reference. However, the great difference between that case and this is that the use of the carriage 12 means that a whole range of different mattress configurations can be introduced into such profiling mattresses.

Thus in the illustrated case the pressure relieving underlay 14 can be provided resulting in a mattress which provides the user with a mattress which is generally passive with the possibility of it being converted into an active pressure relieving mattress simply by connecting a suitable pump to the air inlet tubes 20. This is in general a much cheaper option than having conventional inflatable pressure relieving mattresses.

However, when such mattresses are desired, they could be supported within the carriage 12 in place of the upper portion 13, in which case of course there would be no need for the underlay 14. Equally any other type of pressure relieving device or construction can be supported in the carriage.

Figure 3:
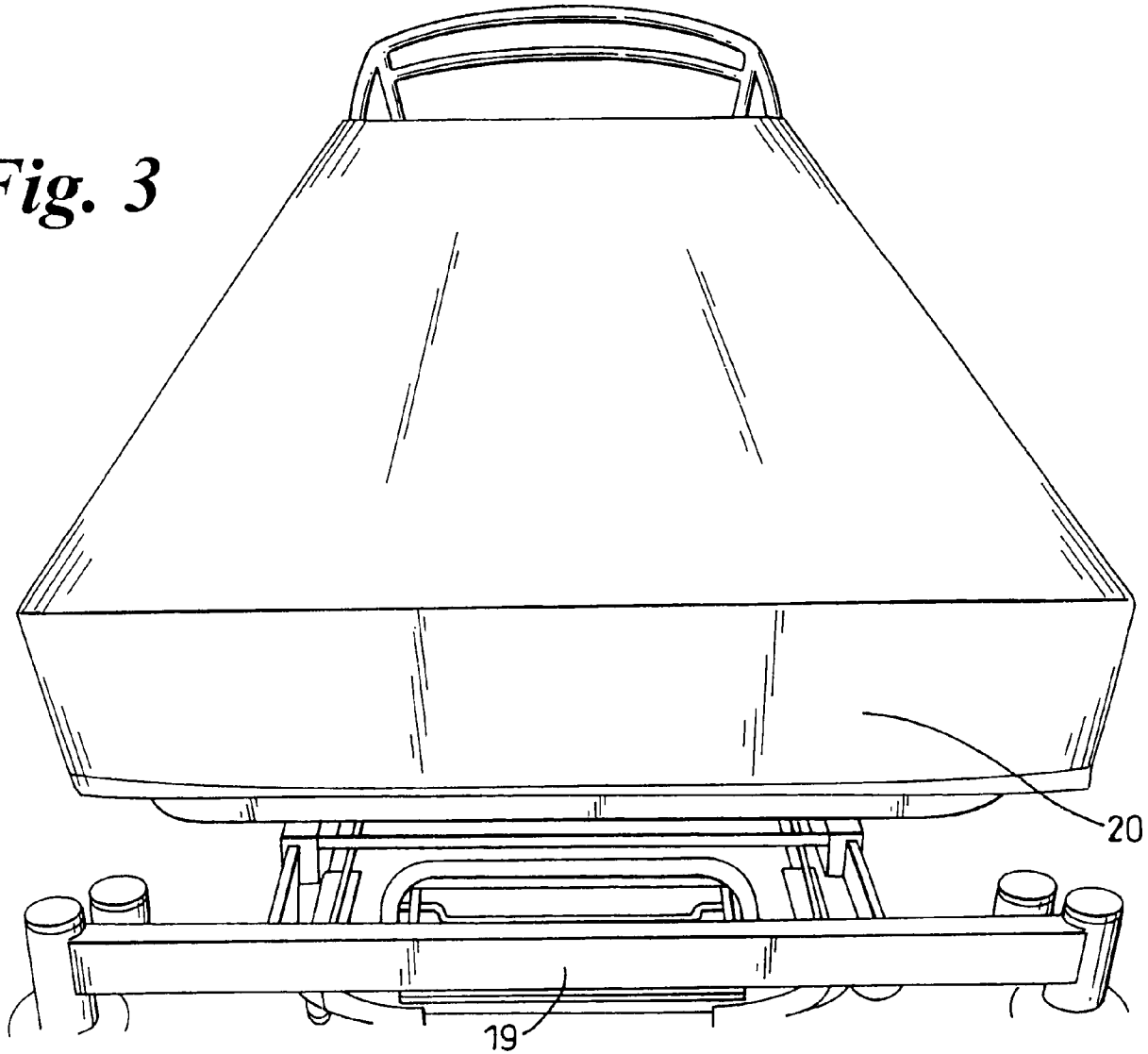
FIG. 3 is a view corresponding to FIG. 1 with the elements of the mattress encapsulated in a resilient cover.

In FIG. 3 the elements 11, 12, 13 and 14 are all encapsulated in a resilient cover 21, which serves to return the elements to their starting alignment, as illustrated in FIG. 1, when the bed 19 is returned to its flat profile.

The underlay 14 may be in the form described in our aforementioned PCT application.

The invention claimed is:

1. A mattress for a profiling bed including a base portion and an upper portion overlying the base portion and having an interface between the portions which has a coefficient of friction low enough such that the portions can slide longitudinally relative to each other characterised in that the upper portion is mounted on a carriage portion and in that the interface lies between the carriage portion and the base portion.

2. A mattress as claimed in claim 1 further including an inflatable pressure relieving underlay between the carriage portion and the upper portion.

3. A mattress as claimed in claim 2 wherein the upper portion is a foam pressure relieving overlay or insert.

4. A mattress as claimed in claim 1 wherein the upper portion is an inflatable pressure relieving mattress or overlay.

5. A mattress as claimed in claim 1 including a resilient cover.

6. A mattress as claimed in claim 2 including a resilient cover.

7. A mattress as claimed in claim 3 including a resilient cover.

8. A mattress as claimed in claim 4 including a resilient cover.

9. A mattress for a profiling bed including:

a base portion;

an upper portion overlying the base portion and having an interface between the portions which has a coefficient of friction low enough such that the portions can slide longitudinally relative to each other characterised in that the upper portion is mounted on a carriage portion and in that the interface lies between the carriage portion and the base portion; and an inflatable pressure relieving underlay between the carriage portion and the upper portion.

* * * * *